United States Patent [19]

Fair

[11] 4,288,933

[45] Sep. 15, 1981

[54] SNOWBLOWER

[76] Inventor: Walter Fair, Box 306, 150 W. Main, Menno, S. Dak. 57045

[21] Appl. No.: 116,405

[22] Filed: Jan. 29, 1980

[51] Int. Cl.[3] ..... E01H 5/09

[52] U.S. Cl. ..... 37/43 B

[58] Field of Search ..... 37/43 R–43 L, 37/20–27; 302/59–63; 277/135

[56] References Cited

U.S. PATENT DOCUMENTS

| | | | |
|---|---|---|---|
| 1,482,048 | 1/1924 | Stephenson | 37/43 B |
| 1,517,190 | 11/1924 | Bryan | 37/43 B |
| 2,315,007 | 3/1943 | Morse et al. | 37/43 B |
| 2,681,516 | 6/1954 | Bourne | 37/43 C |
| 2,732,638 | 1/1956 | Leufvenius | 37/43 B |
| 2,971,279 | 2/1961 | Blanchet | 37/43 B |
| 3,303,588 | 2/1967 | Krause | 37/43 R |
| 3,357,749 | 12/1967 | Seymour et al. | 37/43 R X |
| 3,780,455 | 12/1973 | Stevenson et al. | 37/43 R |
| 3,916,542 | 11/1975 | Blanchet | 37/43 R |
| 3,921,315 | 11/1975 | Tome | 37/43 R |

FOREIGN PATENT DOCUMENTS

| | | | |
|---|---|---|---|
| 580532 | 7/1959 | Canada | 37/43 R |
| 729354 | 3/1966 | Canada | 37/43 R |

*Primary Examiner*—E. H. Eickholt

*Attorney, Agent, or Firm*—Sixbey, Friedman & Leedom

[57] ABSTRACT

The snowblower of the present invention includes a novel housing structure having upwardly extending side cutter bars angling outwardly from the leading sides of the snowblower housing. Beneath the side cutter bars, the lower leading edges of the housing are angled upwardly and provided with pavement protecting skid shoes. The snowblower housing encloses rotatable snow blower fans provided with ice chopper bars which rotate with each fan and cut into the snow. Each snowblower fan is associated with a rotatable discharge spout which is mounted upon a turntable. A novel metallic and plastic bearing assembly is mounted upon the turntable to provide greaseless rotation of the discharge spout, and this bearing assembly is enclosed in a shielding unit to prevent snow and grit from reaching the turntable. All shafts within the snowblower which, through torque or tension, are subject to structural misalignment, are provided with floating oil seals to prevent shaft misalignment from rupturing the oil seal.

13 Claims, 5 Drawing Figures

SNOWBLOWER

DESCRIPTION

Technical Field

This invention relates to industrial snowblowers generally, and more particularly to a novel snowblower having a housing and blade design adapted to facilitate snow removal with enhanced efficiency.

Background of the Invention

Snowblowers have been developed which are propelled by tractors or other vehicles and are operative to remove large quantities of snow from roadways or other large areas. Such snowblowers generally include a self contained power plant to drive rotating snowblower fans which discharge snow through discharge spouts at the top of the blower housing. It will be readily appreciated that the components of these large snowblower units must be able to operate effectively in extremely adverse environmental conditions. Some known snowblowers have encountered difficulties when subjected to large volumes of packed snow or ice. For example, the rotating blower fans in some blowers become caked with heavy snow and fail to lift packed snow or ice from the road surface. Additionally, the leading edges of known commercial snowblowers often fail to ride over a surface being cleared, and instead are forced into the surface when a large volume of snow is encountered.

In large commercial snowblowers, rotating parts are often subjected to extreme stress, and also become damaged through contact with snow and grit.

The present invention provides a snowblower wherein for ice chopper bars rotate with the fan and cut into the snow adjacent the leading face of the fan. Extentions are welded upon the ice chopper bars at right angles to chop out snow in the center of the fan and facilitate the use of the snowblower in hard icy snow.

A still further aspect of the present invention is to provide a novel and improved snow blower wherein rotating shafts and other rotating components of the blower are protected against damage caused by the adverse conditions to which the blower is subjected. The snowblower includes rotating snow discharge spouts which are mounted upon a rotary spout turntable equipped with steel and nylon bearing units to eliminate the need for grease. These bearing units are shrouded in an enclosing shielding structure which prevents snow, grit, and other foreign objects from contaminating the bearing area.

In yet another aspect of the present invention, the various rotating shafts within the snow blower are provided with floating oil seals to preclude oil seal damage previously caused by structural misalignment of the shaft under load.

These and other objects, advantages, and features of the present invention will be more readily apparent from the following detailed description of the preferred embodiment of the invention when taken together with the accompanying drawings.

DESCRIPTION OF THE PREFERRED EMBODIMENT

Figure 1:
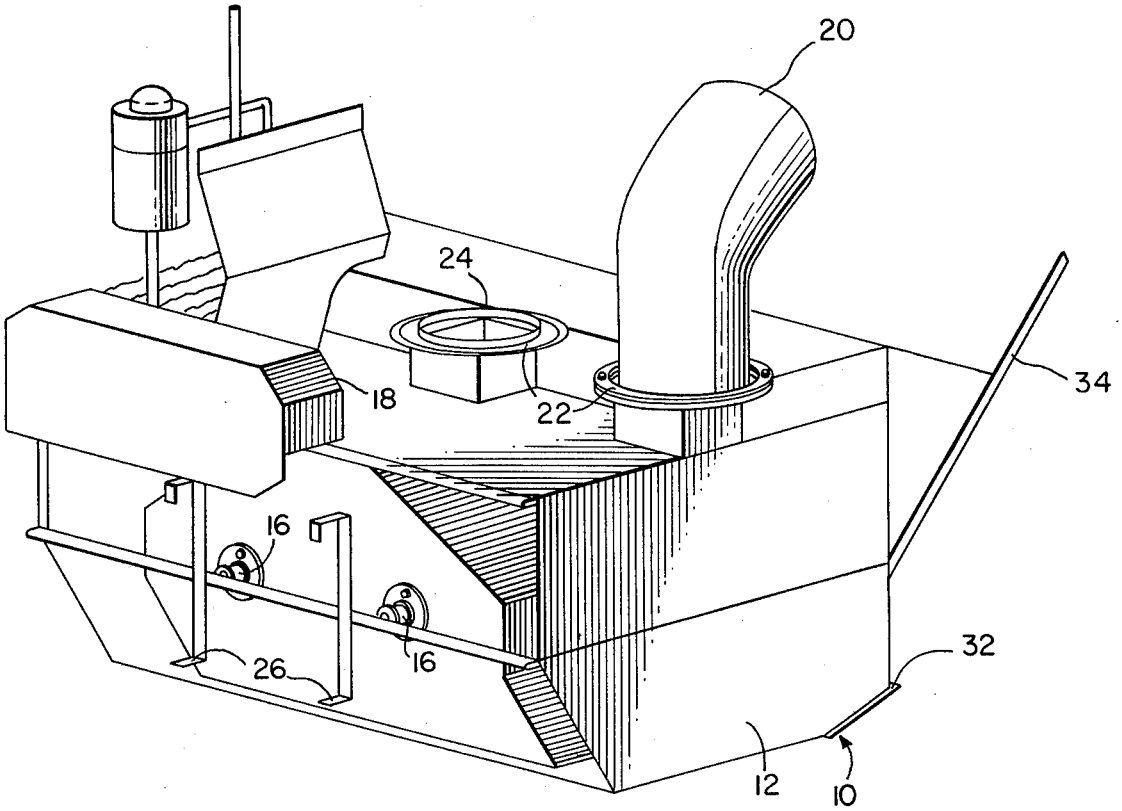
FIG. 1 is a perspective view from the rear side of the snowblower of the present invention.
Figure 5:
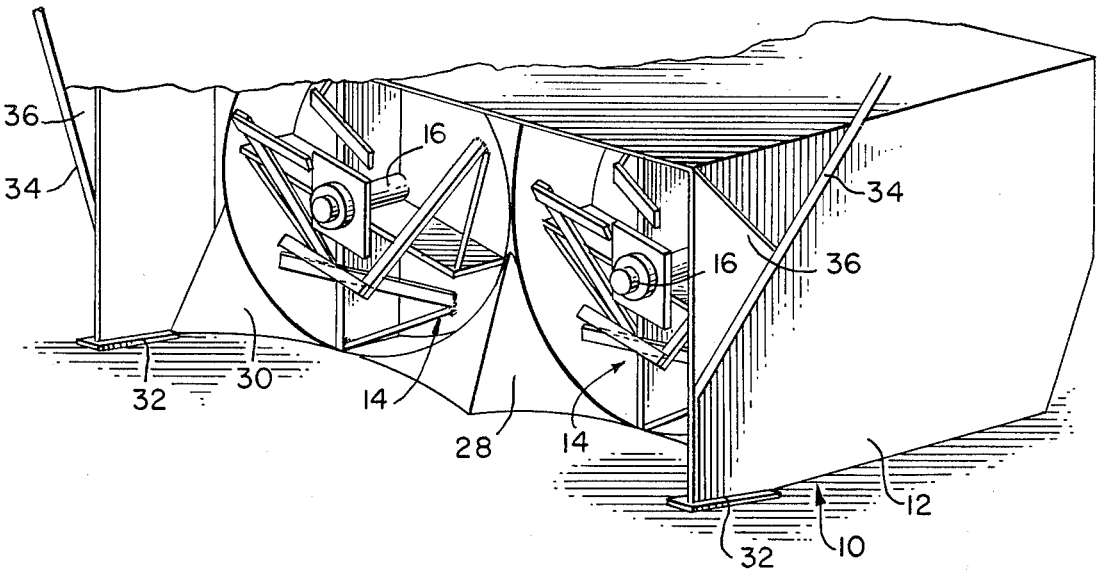
FIG. 5 is a perspective view of a section of the front of the snowblower of FIG. 1.

Referring to the drawings, the snowblower of the present invention indicated generally at 10 includes a housing 12 which encloses one or more rotatably mounted snowblower blades 14, each mounted for rotation about its own central shaft of 16. In FIGS. 1 and 5, the snowblower 10 of the present invention is shown with two rotating snowblower fans 14.

The snowblower fans 14 are driven by a suitable power plant 18 mounted on the housing 12. Each blower fan is associated with a discharge spout 20, one of which is shown in FIG. 1. Each discharge spout is mounted for rotation upon a turntable 22 which is connected with suitable ducting 24 leading to the associated snowblower fan. One snow discharge spout 20 is omitted from FIG. 1 to provide a view of the turntable 22 and ducting 24.

The snowblower 10 is propelled by a tractor or similar vehicle (not shown) which is attached to the snowblower by means of suitable brackets 26. The snowblower housing rides over the surface being cleared on plow shaped baffles 28 and 30 which are angled to feed snow into the snowblower fans 14. In the past, the leading lower edges of the sidewalls of the housing 12 have often been permitted to dig into the surface beneath the snowblower causing damage to such surface, and to prevent this, the snowblower 10 of the present invention includes a housing wherein the lower leading edges are inclined upwardly and provided with shoe skids 32.

A second problem experienced by known industrial snowblowers occurs when the snowblower is cutting along high banks of snow that are higher than the discharge spouts 20. These high banks of snow tend to strike the rotating discharge spout causing damage to the spout. The snowblower 10 of the present invention alleviates this problem by providing side cutter bars 34 which are supported on the sides of the housing 12 adjacent the leading edge of the housing by support members 36, and which extend well above the top wall of the housing. The support members 36 are secured to the housing and support the side cutter bars 34 in an attitude whereby the side cutter members are inclined upwardly, outwardly, and forwardly from the housing 12. The side cutter bars are angled laterally outwardly from the housing for a distance sufficient to permit them to cut a snow bank back away from the side of the housing and allow clearance for the rotating spouts 20.

As previously indicated, the rotating spouts 20 are mounted upon a turntable 22 and rotate on the turntable so that snow being ejected from the discharge spouts 20 is dispersed. The rotating discharge spouts are driven by a chain drive or similar drive mechanism (not shown) which is conventional. In the past, it has been necessary to provide grease to the friction surfaces of the rotating spouts 20 to reduce friction, and such grease might be subjected to freezing which inhibits rotation of the blower spouts. Additionally, grit and foreign material carried by the snow being ejected through the blower spouts 20 has often come into contact with the friction surfaces for the rotating spouts causing damage to such surfaces.

The snowblower 10 of the present invention is provided with a novel snow ejection assembly which is designed to operate without grease and to protect the friction surfaces of the rotating snowblower spouts 20 from foreign material. This snow ejection assembly includes the turntables 22 which are formed at the uppermost end of the ducts 24. The turntable 22 consists of a circular flange 38 which extends out laterally from the upper end of each duct to form a circular turntable surface. The outer peripheral edge of the flange 38 is provided with an upwardly extending circumferential ridge 40 having an upper surface which is spaced above the upper surface of the flange 38.

Figure 2:
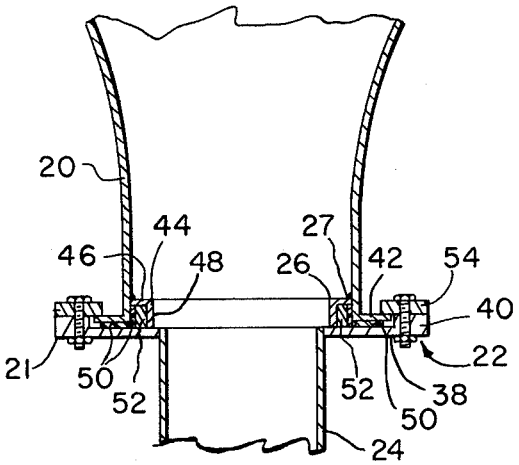
FIG. 2 is a sectional view showing the bearing and mounting structure for a rotating snow discharge spout for the snowblower of FIG. 1.

The lowermost end of a snowblower spout 20 is designed to rest upon the upper surface of the flange 38, and consequently this lowermost end is provided with a circular, laterally extending, circumferential flange 42 which provides the bearing surface for the spout. It will be noted in FIG. 2 that the circumference of the discharge spout 20 adjacent the flange 42 is greater than the circumference of the duct 24 adjacent the flange 38, but the outer circumference of the flange 42 is dimentioned so that the flange will fit within the confines of the ridge 40. Secured to the inner surface of the snow discharge spout 20 adjacent the lower flange 42 is an inner bearing shield 44 which is L shaped in cross section. This inner bearing shield includes an upper leg 46 which conforms to the configuration of the inner surface of the blower spout and which extends inwardly therefrom. A second leg 48 extends downwardly from the innermost edge of the leg 46 and is adapted to contact the upper surface of the flange 38. It will be noted that the leg 48 of the shield 44 is of sufficient length to cause the flange 42 of the blower spout to be spaced above the friction surface of the flange 38. This provides space for a nylon or polyethylene bearing 50 which is L shaped in cross section and which is seated in the space between the flanges 38 and 42. This bearing has a lower leg which conforms to the configuration of the flange 42 and a second leg which rests against the inner surface of the blower spout 20 beneath the leg 46 of the shield 44. A space is left between the leg 48 of the shield 44 and the bearing 50, and this space is filled by a metallic bearing 52, such as a steel bearing. The bearing 52, like the bearing 50, extends completely around the inner periphery of the snow discharge spout 20, so that the space between the snow discharge spout, the shield 44, and the flange 38 is substantially filled with bearing material. With the bearings 50 and 52 in place on the flange 38 and the flange 42 resting in place on the bearings, a hold down ring 54 is bolted or otherwise suitably attached to the upper surface of the ridge 40. The hold down ring extends inwardly over the peripheral edge of the flange 42 to maintain this flange in contact with the bearing 50. However, the hold down ring permits rotation of the flange 42 so that the snow discharge spout 20 is permitted to freely rotate on the turntable 22.

The snowblower fans 14 each include a disc shaped body 56 having a central hub 58 which receives and secures the fan to a drive shaft 16. Suitable fan blades 60 are secured to the forward face of the body 56 and extend radially from the hub 58. The snowblower fan 14 of FIG. 4 includes four flat fan blades **60*a*, 60*b*, 60*c*, and 60*d* which extend radially from the hub 58 at 90° angles about the disc shaped body 56**.

To enable the snowblower fan 14 to operate effectively in hard packed, icy snow, ice chopper bars 62 are secured to the blades 60. Each of these ice chopper bars is angled outwardly from the surface of the body 56, and includes an inner end 64 in contact with the surface of the body. In fact, the inner ends 64 may be secured to the surface of the body so that each ice chopper bar is secured both to the surface of the body and also to the supporting blades 60 at the point where the chopper bar contacts the blade.

Figure 4:
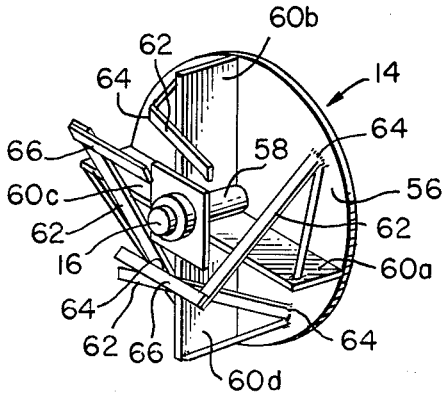
FIG. 4 is a perspective view showing a snowblower fan for the snowblower of FIG. 1.

It will be noted from FIG. 4 that each chopper bar 62 is alternately arranged with respect to an opposed chopper bar. Thus, the chopper bars 62 on the coextensive blades **60*a* and 60*c* are alternately arranged so that the end 64 of the chopper bar on the blade 60*a* is secured to the face of the body 56 above the blade, while the chopper bar on the coextensive blade 60*a* is arranged so that the end 64 thereof is secured to the face of the body 56 below the blade 60*c*. The chopper bars on the coextensive blades 60*b* and 60*d* are similarly arranged in alternate relationship. Thus, as the snowblower fan 14 rotates in a clockwise direction, the raised ends of each chopper bar operate as ice picks to break up hard packed snow in front of the blower fan so that the snow is picked up by the blades 60 and directed into the ducts 24**.

To prevent snow and ice from packing in the center of the snowblower fan 14, extension chopper bars 66 are welded to the raised ends of the opposed chopper bars 62 secured to the blades **60*a* and 60*c*. These extension bars 66 extend toward the center of the body 56 at substantially right angles to the longitudinal axis of the supporting ice chopper bars 62. The extension bars operate to break up hard packed snow which would tend to pack at the center of the snowblower fan 14, around the hub 58**.

Many of the rotating shafts within the snowblower 10 are subjected to high, off center loads which tend to structurally misalign such shafts. Also, due to the high loads causing friction on the rotating shafts within the snowblower, it is critical that the shafts be properly lubricated at all times. In the past, it has been found that slight misalignments of a shaft under load, such as for example, the shafts 16 for the snowblower fans 14, would cause the oil seals for the shaft to rupture or become damaged, and proper lubrication of the shaft would become interrupted.

Figure 3:
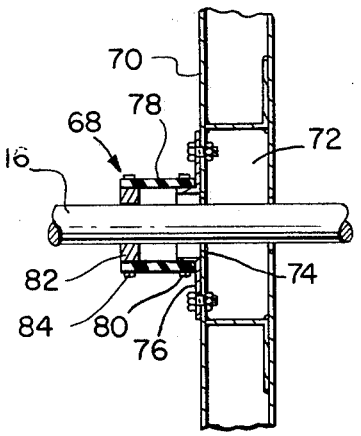
FIG. 3 is a sectional view showing the floating shaft oil seal for the snowblower of FIG. 1.

FIG. 3 discloses a floating oil seal which is employed within the snowblower 10 of the present invention to maintain proper lubrication of all rotating shafts. For purposes of example, this floating oil seal indicated generally at 68 is shown in conjunction with a blower fan shaft 16. A support structure 70 for the shaft 16 is secured to the housing 12, and includes an oil containing chamber 72 which provides oil to the shaft. The shaft 16 extends through the chamber 72 and out through an opening 74 in the chamber. An outwardly projecting flange structure 76 is secured to the wall of the chamber 72 and surrounds the opening 74. A rubber, plastic, or similar flexible tubular member 78 is secured at one end to the flange 76 by means of a suitable hose clamp or other clamping member 80. An oil seal 82 of any known conventional type is secured within the outer end of the tubular member 78 and engages in sealing relationship against the rotating shaft 16. This shaft extends through the tubular member and outwardly of the oil seal. An external hose clamp or similar clamping member 84 may be secured about the outer end of the tube 78 to maintain the oil seal in tight sealing relationship with the shaft 16.

It will be noted that should the shaft 16 become slightly misaligned, the tubular member 78 will flex so that misalignment of the shaft does not damage the oil seal 82. Although only one floating oil seal 68 has been shown in FIG. 3, obviously such an oil seal would be employed on both sides of the chamber 72 to effectively seal the shaft 16.

Industrial Applicability

The snowblower 10 of the present invention operates effectively when propelled by a tractor or other vehicle to remove hard packed snow from a surface to be cleared. The upwardly angled skids 32 beneath the leading edges of the housing 12 permit the snowblower to be propelled forwardly without risk of damage to an underlying surface. As the snowblower moves in a forward direction, the forwardly and laterally angled side cutter bars 34 extend above the top wall of the housing 12 and cut away snow banks in the path of the rotating discharge blower spouts 20 for the snowblower. Simultaneously, the ice chopper bars 62 on the rotating snowblower fans 14 and the extension bars 66 break up the hard snow in the path of the snowblower fans so that this snow may be effectively fed by the snowblower fans into the ducts 24. Snow passing through the ducts and into the rotating snowblower spouts 20 is prevented from entering the bearing area for the snowblower spouts by the shielding unit 48. This shielding unit operates in conjunction with the flange 42 on the bottom of the snowblower spout and the turntable 22 on the end of the ducts 24 to enclose solid bearings 50 and 52 for the snowblower spout.

Floating oil seals 68 provided on the shaft 16 for the snowblower fans 14 and upon other rotating shafts within the snowblower 10 operate to prevent damage to the shaft oil seal when the shaft becomes structurally misaligned. Thus continuous lubrication of each loaded shaft is effectively provided.

It is anticipated that aspects of the present invention, other than those specifically defined in the appended claims, can be obtained from the foregoing description and the drawings.

I claim:

1. A snowblower comprising a blower housing means having a forward end, snowblower fan means rotatably mounted within said housing means to engage snow passing into the forward end of said housing means, and snow discharge means mounted upon said housing means and adapted to receive snow from said snowblower fan means, said snow blower fan means including a fan body having a flat, circular surface extending in a first plane, a plurality of fan blades on said fan body extending outwardly from adjacent the center of said fan body, each said fan blade projecting from said flat circular surface and having a forward portion positioned outwardly from said first plane, and elongated ice chopper bars mounted upon said fan body and extending transversely across said fan blades, each said chopper bar being in contact with the forward portion of a fan blade at a point intermediate the ends of said chopper bar, the chopper bars being positioned to extend at an acute angle to said first plane.

2. The snowblower of claim 1, wherein each said fan blade includes a flat blade member which extends radially from a point adjacent the center of said flat circular surface to a point adjacent the periphery thereof, said fan blades being arranged to divide said flat circular surface into four ninety degree segments.

3. The snowblower of claim 2, wherein each said chopper bar includes an inner end in contact with said flat circular surface within one of said ninety degree segments and an outer end extending over and spaced above the next adjacent ninety degree segment, the inner end of the chopper bars contacting only one of said flat blade members being in contact with said flat circular surface within anyone of said ninety degree segments.

4. The snowblower of claim 1, wherein said housing means includes spaced sidewalls extending on either side of said snow blower fan means, the bottom edge of each of said sidewalls being inclined upwardly at the forward end of said housing means, and skid means secured to the inclined portion of each said bottom edge.

5. The snowblower of claim 1, wherein said housing means includes spaced sidewalls extending on either side of said snowblower fan means, a top wall extending between said sidewalls, and snow cutter means extending from said housing means adjacent the forward end thereof, said snow cutter means extending outwardly beyond the plane of at least one of said sidewalls and upwardly above the plane of said top wall.

6. A snowblower comprising a blower housing means having a forward end, snowblower fan means rotatably mounted within said housing means to engage snow passing into the forward end of said housing means, and snow discharge means mounted upon said housing means and adapted to receive snow from said snowblower fan means, said snow blower fan means including a fan body having an outer surface facing the forward end of said housing means, a plurality of fan blades on said fan body extending outwardly from adjacent the center of said fan body, each said fan blade projecting from said outer surface and having a forward portion positioned outwardly from said outer surface, and elongated ice chopper bars mounted upon said fan body and extending transversely across said fan blades with each said chopper bar being in contact with the forward portion of a fan blade intermediate the ends of said chopper bar, the chopper bars being positioned to extend at an acute angle to said outer surface and having an outer end which is positioned a greater distance from said outer surface than an inner end thereof, at least one said chopper bars having an elongated extension bar extending therefrom adjacent said outer end, said extension bar being positioned to extend inwardly away from the periphery of said outer surface.

7. The snowblower of claim 6, wherein said outer surface is circular in peripheral configuration, each said fan blade includes a flat blade member which extends radially from a point adjacent the center of said outer surface to a point adjacent the periphery thereof, and said elongated extension bar extends substantially parallel to the blade member contacted by the chopper bar from which said extension bar extends.

8. A snowblower comprising a blower housing means having a forward end, spaced sidewalls and a top wall extending between said sidewalls, snow discharge means including fan means rotatably mounted within said housing means to discharge snow contacted thereby, and snow cutter means extending from said housing means adjacent the forward end thereof, said snow cutter means including an elongated cutter bar extending outwardly from said housing means beyond the plane of at least one of said sidewalls and upwardly above the plane of said top wall, and mounting means secured to the lower portion of said cutter bar to mount said cutter bar on said housing means, said mounting means positioning said cutter bar to extend angularly outwardly and upwardly relative to a sidewall of said housing means.

9. The snowblower of claim 8, wherein said mounting means positions said cutter bar to extend angularly beyond the forward end of said housing means.

10. The snowblower of claim 8, wherein the bottom edge of each of said sidewalls is inclined upwardly at the forward end of said housing means, and a skid means is secured to the inclined portion of each said bottom edge.

11. A snowblower comprising a blower housing means, snowblower means rotatably mounted within said housing means, and snow discharge means mounted upon said housing means to convey snow from said snowblower means, said snow discharge means including a duct having an open end extending from said housing means, a flange extending laterally and outwardly from the duct about the open end thereof to provide a turntable, an open ended discharge spout having an inner end mounted for rotation on said turntable, said inner end having a mounting flange extending laterally and outwardly therefrom about the opening in said inner end, and shielding means extending outwardly from the inner end of said spout below said mounting flange to contact said turntable and space said mounting flange from said turntable, said shielding means extending completely around the opening in said inner end of said spout, solid bearing means mounted upon said turntable in the space between said turntable and said mounting flange, and retaining means connected to said turntable to secure said mounting flange to said turntable for rotation thereon.

12. A snowblower comprising a blower housing means having a forward end, snowblower fan means rotatably mounted within said housing means to engage snow passing into the forward end of said housing means, and snow discharge means mounted upon said housing means and adapted to receive snow from said snowblower fan means, said snowblower fan means including a fan body, a plurality of fan blades on said fan body extending outwardly from adjacent the center of said fan body, elongated ice chopper bars mounted upon said fan body and extending transversely across said fan blades, at least one rotatable, elongated shaft for driving said fan body mounted within said housing means and lubrication means for said shaft, said lubrication means including structural support means having an aperture through which said shaft passes, flexible enclosure means having an inner end surrounding said aperture and secured to said structural support means and an outer end spaced from said inner end, said flexible enclosure means enclosing said shaft, and oil seal means mounted within said enclosure means and extending between said enclosure means and said shaft, said oil seal means being spaced from the inner end of said enclosure means.

13. A snowblower comprising a blower housing means having a forward end, snowblower fan means rotatably mounted within said housing means to engage snow passing into the forward end of said housing means, said snowblower fan means including a fan body, a plurality of fan blades on said fan body extending outwardly from adjacent the center of said fan body, and elongated ice chopper bars mounted upon said fan body and extending transversely across said fan blades, and snow discharge means mounted upon said housing means and adapted to receive snow from said snowblower fan means, said snow discharge means including a duct having an open end extending from said housing means, a flange extending laterally and outwardly from the duct about the open end thereof to provide a turntable, an open ended discharge spout having an inner end mounted for rotation on said turntable, said inner end having a mounting flange extending laterally and outwardly therefrom about the opening in said inner end, and shielding means extending outwardly from the inner end of said spout below said mounting flange to contact said turntable and space said mounting flange from said turntable, said shielding means extending completely around the opening in said inner end of said spout, solid bearing means mounted upon said turntable in the space between said turntable and said mounting flange, and retaining means connected to said turntable to secure said mounting flange to said turntable for rotation thereon.

* * * * *